US005375671A

United States Patent [19]

Horvei

[11] Patent Number: 5,375,671

[45] Date of Patent: Dec. 27, 1994

[54] CONVERTER GROUP AND PRESSURE CONVERTER FOR USE THEREIN

[75] Inventor: Knut V. Horvei, Sandnes, Norway

[73] Assignee: Den Norske Stats Oljeselskap A.S., Stavanger, Norway

[21] Appl. No.: 50,446

[22] PCT Filed: Nov. 4, 1991

[86] PCT No.: PCT/NO91/00135

§ 371 Date: Oct. 27, 1993

§ 102(e) Date: Oct. 27, 1993

[87] PCT Pub. No.: WO92/8872

PCT Pub. Date: May 29, 1992

[30] Foreign Application Priority Data

Nov. 19, 1990 [NO] Norway ..... 904991
Nov. 19, 1990 [NO] Norway ..... 904992

[51] Int. Cl.[5] ..... E21B 4/02

[52] U.S. Cl. ..... 175/93; 175/101; 175/107

[58] Field of Search ..... 175/24, 25, 73, 94, 175/101, 107

[56] References Cited

U.S. PATENT DOCUMENTS

| | | | |
|---|---|---|---|
| 3,112,800 | 12/1963 | Bobo | 175/67 |
| 4,047,581 | 9/1977 | Erickson | 175/95 |
| 4,141,225 | 2/1979 | Varner | 64/2 P |
| 4,290,496 | 9/1981 | Briggs | 175/321 |
| 4,880,067 | 11/1989 | Jelsma | 175/73 |
| 4,895,214 | 1/1990 | Schoeffler | 175/73 X |
| 4,899,835 | 2/1990 | Cherrington | 175/73 X |
| 5,154,243 | 10/1992 | Dudman | 175/75 |
| 5,246,080 | 9/1993 | Howei et al. | 175/93 |

FOREIGN PATENT DOCUMENTS

| | | |
|---|---|---|
| 0335543 | 10/1989 | European Pat. Off. . |
| 83/00183 | 1/1983 | WIPO . |
| 91/07566 | 5/1991 | WIPO . |

*Primary Examiner*—Ramon S. Britts
*Assistant Examiner*—Frank S. Tsay
*Attorney, Agent, or Firm*—Foley & Lardner

[57] ABSTRACT

Converter group comprising at least two pressure converters adapted to be mounted in a row axially above the drill bit at the lower end of a drill pipe for deep drilling, in particular for oil and gas, and for generating an increased fluid pressure utilizing energy in a drilling fluid flow down through the drill pipe, so as to obtain an enhanced drilling effect, preferably by means of one or more high pressure jets adapted to have a cutting action in a surrounding rock formation. Pressure converters (20A, 20B) have axially abutting end faces (22A, 22B) of spherical shape. Attachment means for axial interconnection of the pressure converters are resilient or flexible so as to make possible a certain, small freedom of angular movement between the axes of the pressure converters.

10 Claims, 5 Drawing Sheets

CONVERTER GROUP AND PRESSURE CONVERTER FOR USE THEREIN

BACKGROUND OF THE INVENTION

1. Field of the Invention

This invention relates to an improved design of a pressure converter for mounting above the drill bit at the lower end of a drill pipe for deep drilling, in particular for oil and gas, for the purpose of generating an increased fluid pressure by utilizing energy in a drilling fluid flow downwards through the drill pipe.

The object of the invention is to provide improvements in a pressure converter of the kind being subject to the applicants international patent application PCT/NO90/00164, whereby it has been found possible to obtain more advantageous solutions in certain important parts of the design.

2. Description of the Prior Art

Various proposals are previously known for such utilization of the drilling fluid flow, in particular in order to obtain an enhanced or more efficient drill operation. An example of such known techniques is to be found in the international patent application, PCT/EP82/00147. This example relates to the employment of an impact effect brought about with the drilling fluid flow as a source of energy, so as to enhance the drilling action.

Of particular interest to the present invention is the employment of one or more high pressure jets adapted to make the drilling more effective by providing a cutting action in a surrounding rock formation. This is also previously known per se, inter alia from U.S. Pat. No. 3,112.800, which describes a method including the use of a pressure converter apparatus for generating the required high pressure. The invention, however, is directed to a novel design of a pressure converter for generating the required high fluid pressure.

International patent application PCT/NO90/00164 relates to a pressure converter comprising drive means adapted to be driven by the drilling fluid flow and to move valve means controlling piston means for reciprocating movement with a pressure stroke and a return stroke, said piston means having at one side a relatively large piston area adapted to be subjected to the drilling fluid pressure in the drill pipe during the pressure stroke, and having at the other side a first, opposite piston area which both during the pressure stroke and the return stroke is subjected to the return pressure in the drilling fluid flow upwards outside the drill pipe, and a second, opposite and relatively small piston area which during the pressure stroke is adapted to generate an increased pressure in a smaller portion of the drilling fluid flow, whereby a check valve provides for discharge of this smaller portion of the flow to a header channel which leads forward to the drill bit, whereas the large piston area during the return stroke is adapted to be subjected to the return pressure outside the drill pipe and the small piston area to the pressure in the drill pipe.

Moreover, in the application mentioned above, there is described an arrangement of several pressure converter units being interconnected end to end in their longitudinal direction, in order to obtain a combined, increased capacity. Such a converter group composed by modules are of very great interest in practice.

SUMMARY OF THE INVENTION

The problem to which the present invention is particularly directed, relates to the function of the assembled group of converters, especially in the case of deviation drilling with a certain, small curvature of the drill pipe which surrounds the converter group. Such curvature during drilling, i.e. with rotation of both the drill pipe and the converter group, can apparently involve large strains and stresses in the joint between the individual pressure converter units or modules included in the group.

According to the invention in a group of pressure converters as described in international patent application PCT/NO90/00164 as referred to above, there is provided a solution to the problem mentioned, which in the first place consists therein that the pressure converters have axially abutting end faces of spherical shape and that attachment means for axial interconnection of the pressure converters are resilient or flexible in order to make possible a certain, small angular movement between the axes of the pressure transformers.

In this manner there is obtained a sufficient flexibility in the converter group as a whole, so that the desired movement between the modules will be possible without overloading or damaging any part of the structure. It is avoided, inter alia, that the pressure converter modules are subjected to bending strain.

Advantageously, the valve means mentioned is formed by a plate shaped body being adapted to rotate about a central axis coinciding with the longitudinal axis of the pressure converter and the drill pipe. A transmission mechanism serves to transfer the movement of the drive means to a desired movement of the valve means. A number of pressure converters, for example a number of 15 to 18 units, are in practice interconnected so as in common to provide for the desired amount of drill mud of high pressure. These pressure converters are then driven by a common through-running drive axle which transfers the movement from the drive means mentioned to the individual valve means in all pressure converter units incorporated in the group. One point in connection with a converter group is also that one or a small number of the converter units may be subject to failure without a too large reduction of the total capacity.

Another problem with which the present invention is concerned, is in fact due to the risk that one of the pressure converter units in the converter group shall be stopped, for example as a result of skewness wear or foreign particles in the flow of drilling mud. What in particular may happen is that for such reasons the valve means is blocked and cannot any longer be moved or rotated without damaging parts of the structure, so that there may be a risk of failure of the converter group as a whole.

As a remedy in this connection it is proposed according to the invention that the transmission mechanism comprises weakened or slipping means which upon overloading puts the transmission mechanism out of operation, so that movement of the drive means does not result in movement of the valve means concerned. Accordingly, failure or blocking of one pressure converter will only lead to stopping of this single converter unit, while the common drive axle can continue without hindrance to keep the remaining pressure converter units in the group of converters, in normal operation.

Additional novel and specific features according to the invention are found in the claims.

BRIEF DESCRIPTION OF THE DRAWING

In the following description the invention shall be explained more closely with reference to the drawings, in which.

DESCRIPTION OF THE PREFERRED EMBODIMENT

Figure 1:
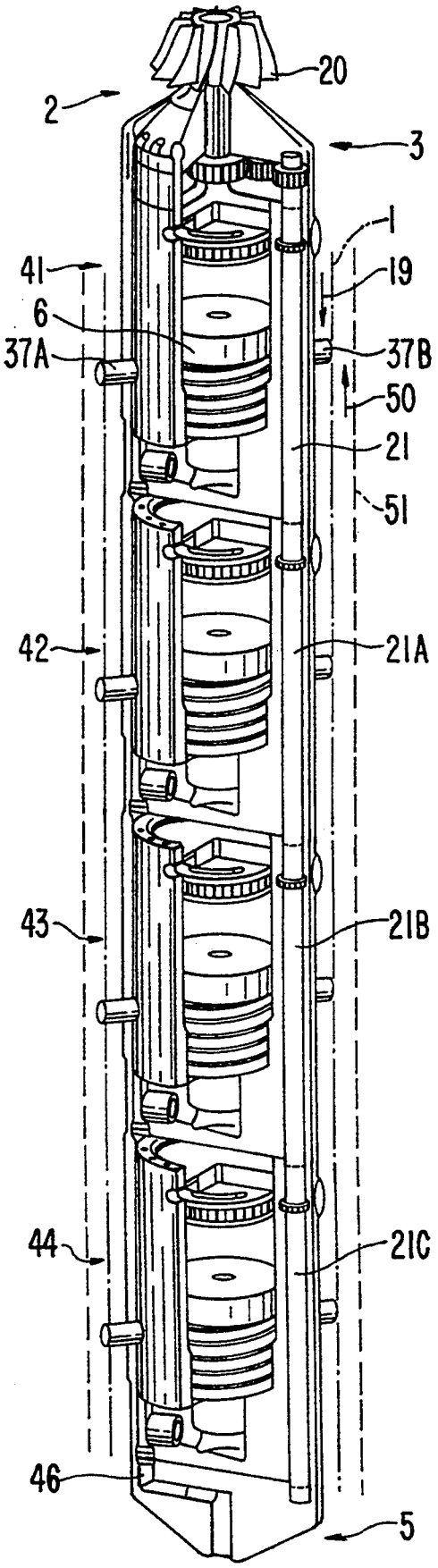
FIG. 1 corresponds to FIG. 7 in international patent application PCT/NO90/00164 and shows an overview of a group of four pressure converter units with a surrounding drill pipe or drill string and a casing schematically illustrated.

FIG. 1 shows an arrangement according to international patent application PCT/NO90/00164, with four pressure converter units 41, 42, 43 and 44 being interconnected in the longitudinal direction and end to end, whereby a top piece 3 is mounted on unit 41, whereas a bottom piece 5 is mounted on unit 44. At converter unit 41 there are indicated tube members 37A and 37B serving to connect the unit to the annulus between the drill pipe 1 and the casing 51, wherein during operation there is an upwardly directed drill mud flow 50. Correspondingly, there is a downwardly directed flow 19 of drilling fluid within the drill pipe or string 2. Moreover, there is shown a drive axle 21 which is rotationally coupled to the drive axle 21A, 21B and 21C respectively of the other units.

The top piece 3 carries drive means in the form of a turbine 20 adapted to be driven by the drilling fluid flow, whereby a gear transmission conveys the power from the turbine axle to the assembled drive axles for rotating these in common and thereby provide for the intended control of the valve means in the converter units. It is an advantage to have these phase shifted, i.e., with mutual angular displacement, so that the pressure strokes and thereby the high pressure outputs from each of the units to the common header channel are smoothed to a more constant high pressure flow than will result from each individual pressure converter. Two other check valves (not shown) admit drill mud to the high pressure space 32 from the main flow of drill mud within the surrounding drill pipe. At 46 the heater channel is extended into the bottom piece 5 which has a central outlet for further fluid flow to the region at the drill bit (not shown).

Figure 2:
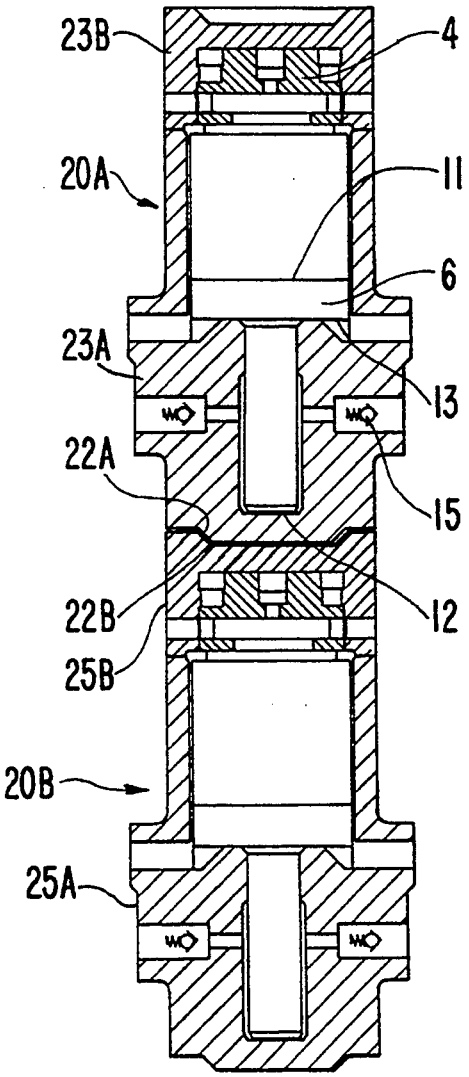
FIG. 2 shows in axial section substantial parts of two interconnected pressure converters based on the design according to this invention, FIG. 3 in a strongly enlarged section shows details of the interconnection between the two pressure converters in FIG. 2.

The joint between the individual pressure converters in the arrangement of FIG. 1 is not so designed that deviation drilling with accompanying strains and stresses can normally be permitted. In contrast the two interconnected pressure converter units 20A and 20B in FIG. 2 are designed in such a way that the problems of deviation drilling are overcome. For completeness in FIG. 2 the unit 20A is shown with valve means 4 and piston means 6 having associated piston surfaces 11, 12 and 13 as well as a valve 15, as described more closely in the international patent application referred to above.

The axially abutting engagement or end faces 22A and 22B at the lower end of pressure converter 20A and at the upper end of pressure converter 20B respectively, have a spherical shape, i.e. in this embodiment being shaped as annular segments of a sphere. With such a design the units 20A and 20B may assume an axial skew with a certain, small angle in relation to each other, determined by among other things clearances at the end faces outside the spherical abutting faces and the means of attachment serving to keep the pressure converter units interconnected.

With reference to FIG. 2 it is further remarked that the housing of the pressure converters may be considered to be composed of two main parts, namely the cylinder part 23A and the top part 23B as far as unit 20A is concerned, and correspondingly a top part 25B and a cylinder part 25A for unit 20B. The abutment faces 22A and 22B referred to are thus formed at the bottom of cylinder part 23A and at the top of top part 25B respectively.

Figure 3:
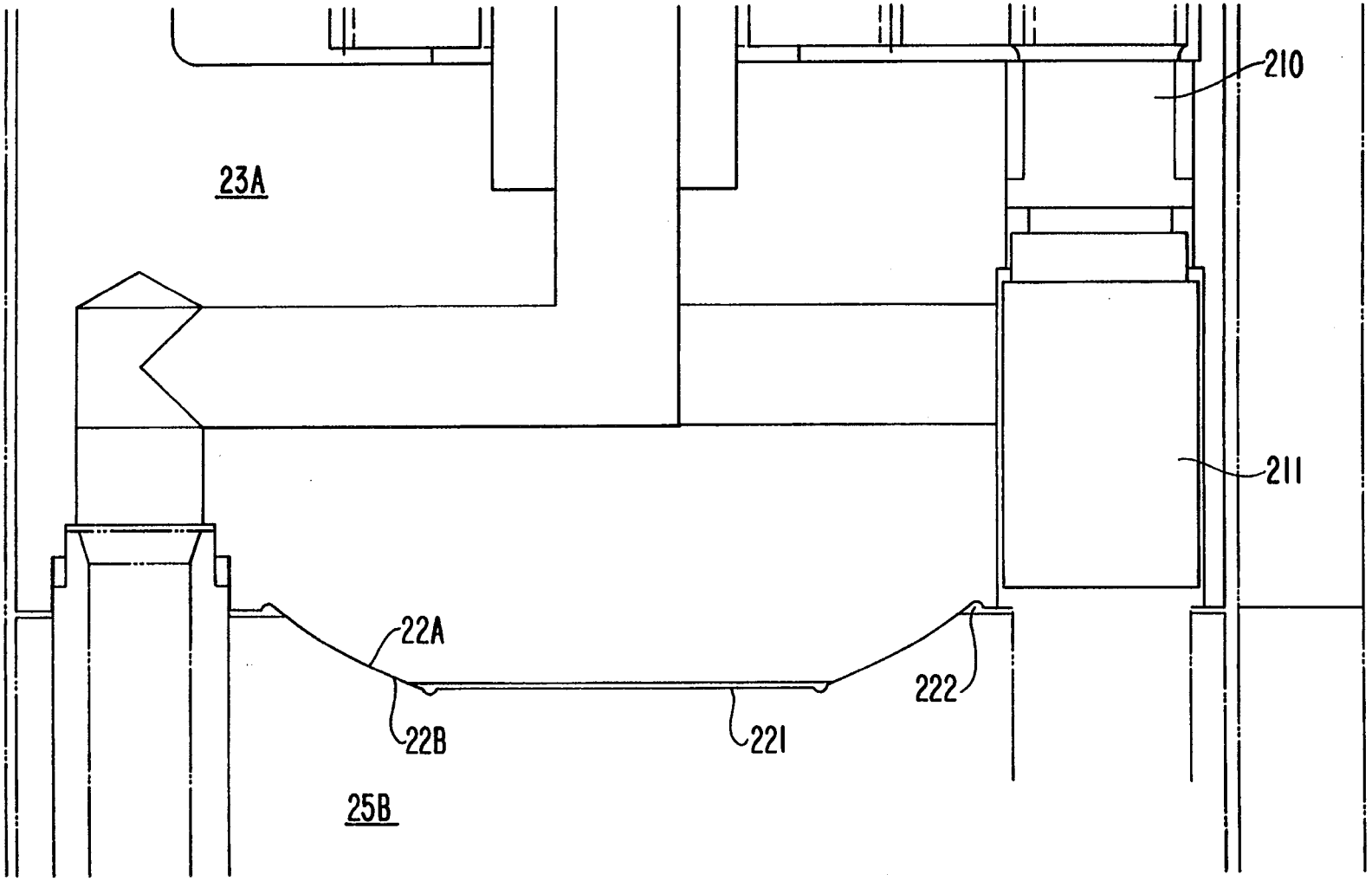

FIG. 3 shows in closer detail a suitable design of the surfaces in association with the spherical abutting faces 22A and 22B. Thus, with the design shown there will be a central clearance 221 and a more peripheric clearance 222 between the abutting parts 23A and 25B. The figure also partially shows a through-running drive axle 210 which is divided into sections corresponding to the length of each pressure converter, which involves an axle coupling as schematically indicated at 211. Various known types of axle couplings permits a certain flexibility or angle variation, which is necessary in connection with the possibility of skewness between two adjacent pressure converters, as mentioned above. Moreover, there is provided a through-running header channel for high pressure drilling fluid from one converter unit to the next converter unit, and appropriate seals which have a reliable function also with the angle variations which may occur here, can be designed on the basis of known solutions.

Figure 5:
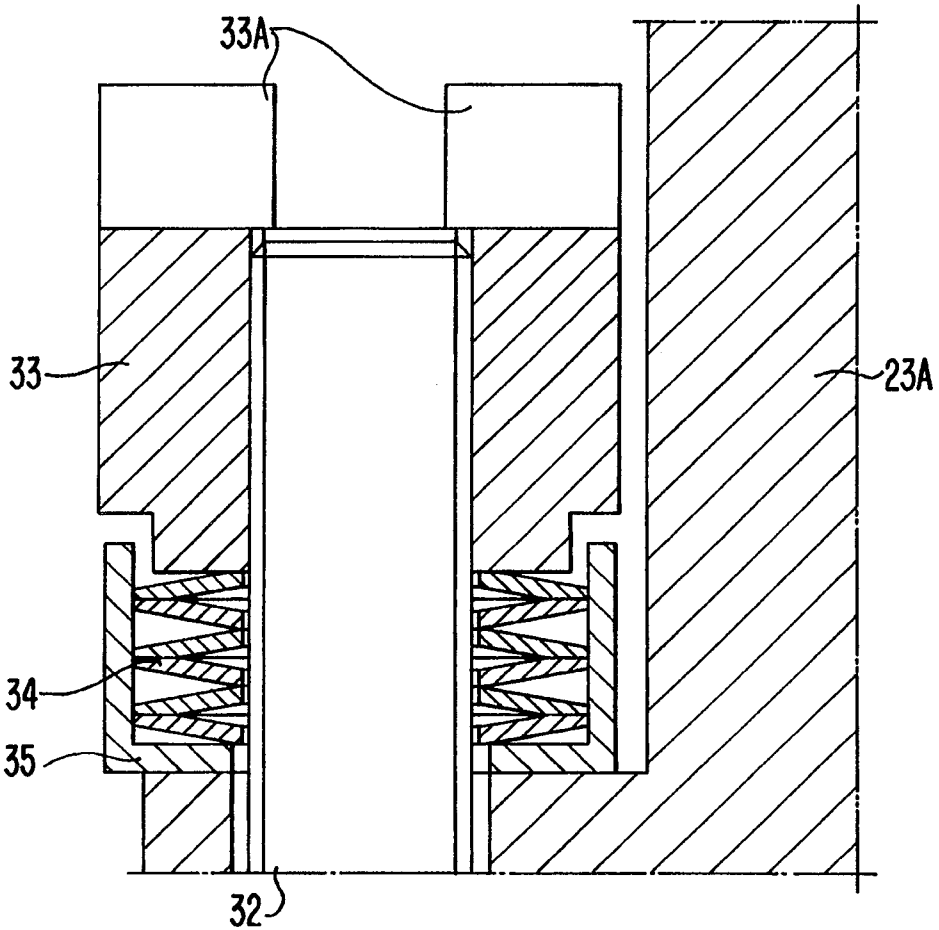
Figure 4:
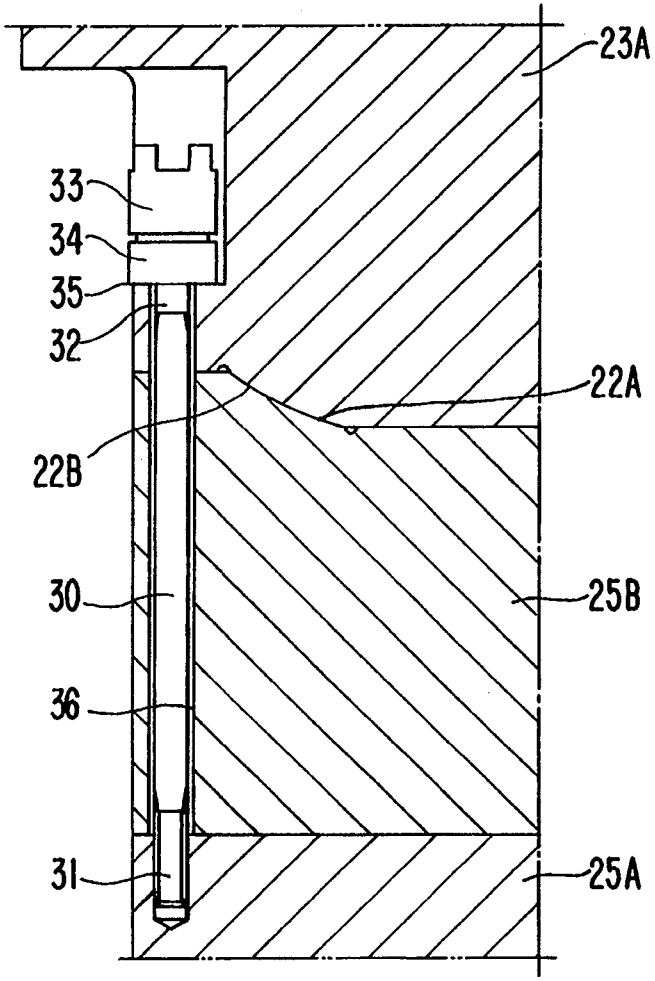
FIG. 4 shows a detail of one of the attachment bolts which serves to join two pressure converters as in FIGS. 2 and 3, FIG. 5 in enlarged sectional view shows details of the nut on top of the attachment bolt in FIG. 4.

As shown in FIG. 4 any two contiguous pressure converters are bolted together by means of a bolt system based on stud bolts 30. A threaded portion 31 of the stud bolt is entered into threads at the top of cylinder part 25A and extends through a bore 36 in top part 25B. Bore 36 has a diameter being clearly larger than the diameter of stud bolt 30, so that the resulting clearance or play contributes to the flexibility of the whole interconnection. A nut 33 is tightened at an upper threaded portion 32 of stud bolt 30 and at this point it is important to provide a particular structural design for making possible the required resiliency or flexibility as mentioned earlier. For this purpose a compression spring 34 is arranged underneath nut 33 and the spring is surrounded by a protective part 35. Structural details in this connection are shown more clearly in FIG. 5.

The axial section through the structure around the upper threaded portion 32 of the stud bolt (FIG. 5), shows cup springs 34 underneath nut 33 and a cup shaped protective part 35 which in particular encloses the springs radially outwards. The lower portion of nut 33 has a reduced lateral dimension in order to be able to enter into protective part 35 and compress springs 34. For tightening nut 33 this can have a particularly shaped crown 33A for a suitable tool. Cup springs 34 are precompressed to a certain level by means of nut 33, at the same time as during assembly care is taken that there is a sufficient clearance between the nut and the base for the bending or movement to be permitted.

With an adequate tightening of nut 33 and a number of corresponding nuts around the periphery of the pressure converters, at the same time as other details in the assembly are observed as explained, the desired movements between the pressure converter units can take place without any overloading of the units in the way of bending strain or in any other way; nor will the stud bolts 30 themselves be subjected to overloading.

For example a converter group can consist of as many as 15–18 pressure converter units which may be employed during drilling operations in boreholes down to 4–5000 meters for the purpose of producing oil or gas. Such a converter group will have a quite significant length and in the case of deviation drilling, i.e. drilling out from the vertical direction, can be subjected to bending due to angling of the drill pipe, which by simultaneous rotation during drilling results in the comprehensive and complicated strains and stresses referred to and which are eliminated by the present invention.

Figure 6:
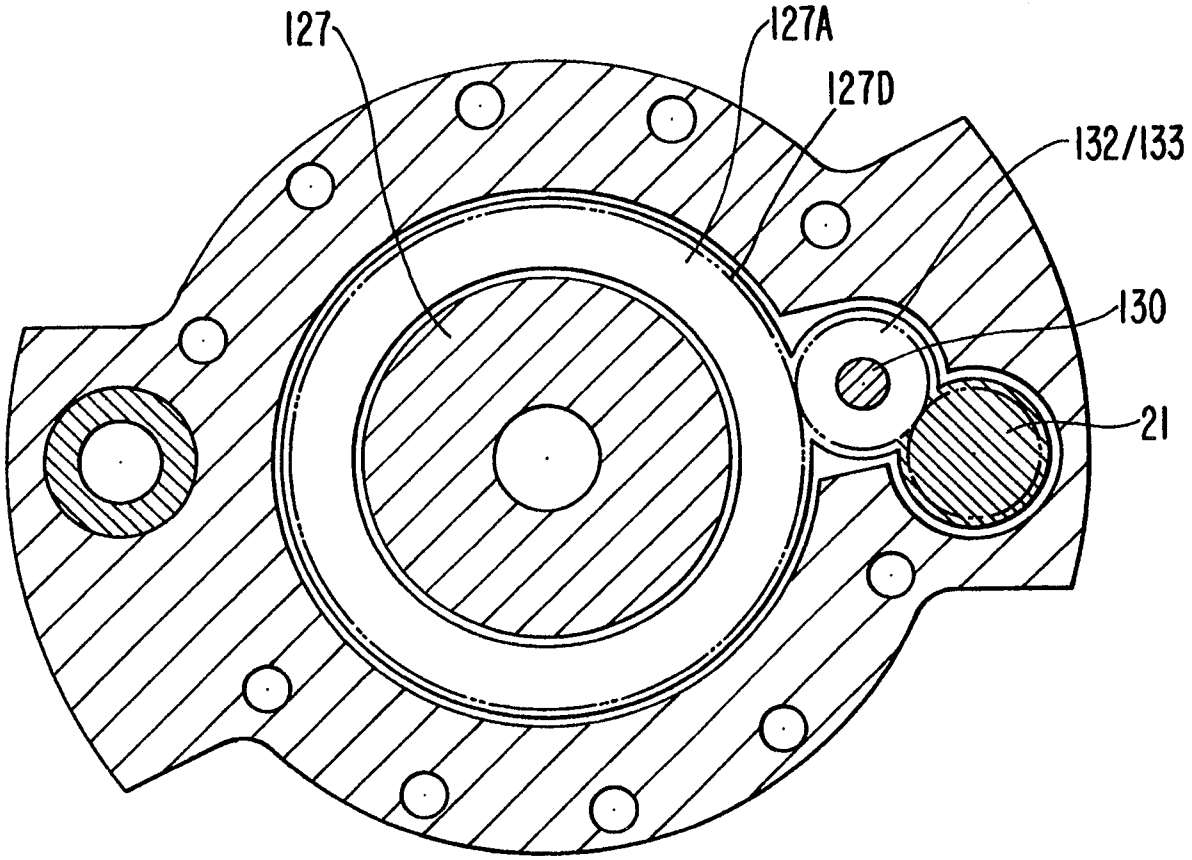
FIG. 6 shows a cross-section through a transmission mechanism for one of the pressure converters in FIG. 1, being based on a gear transmission of the movement from the drive axle.
Figure 7:
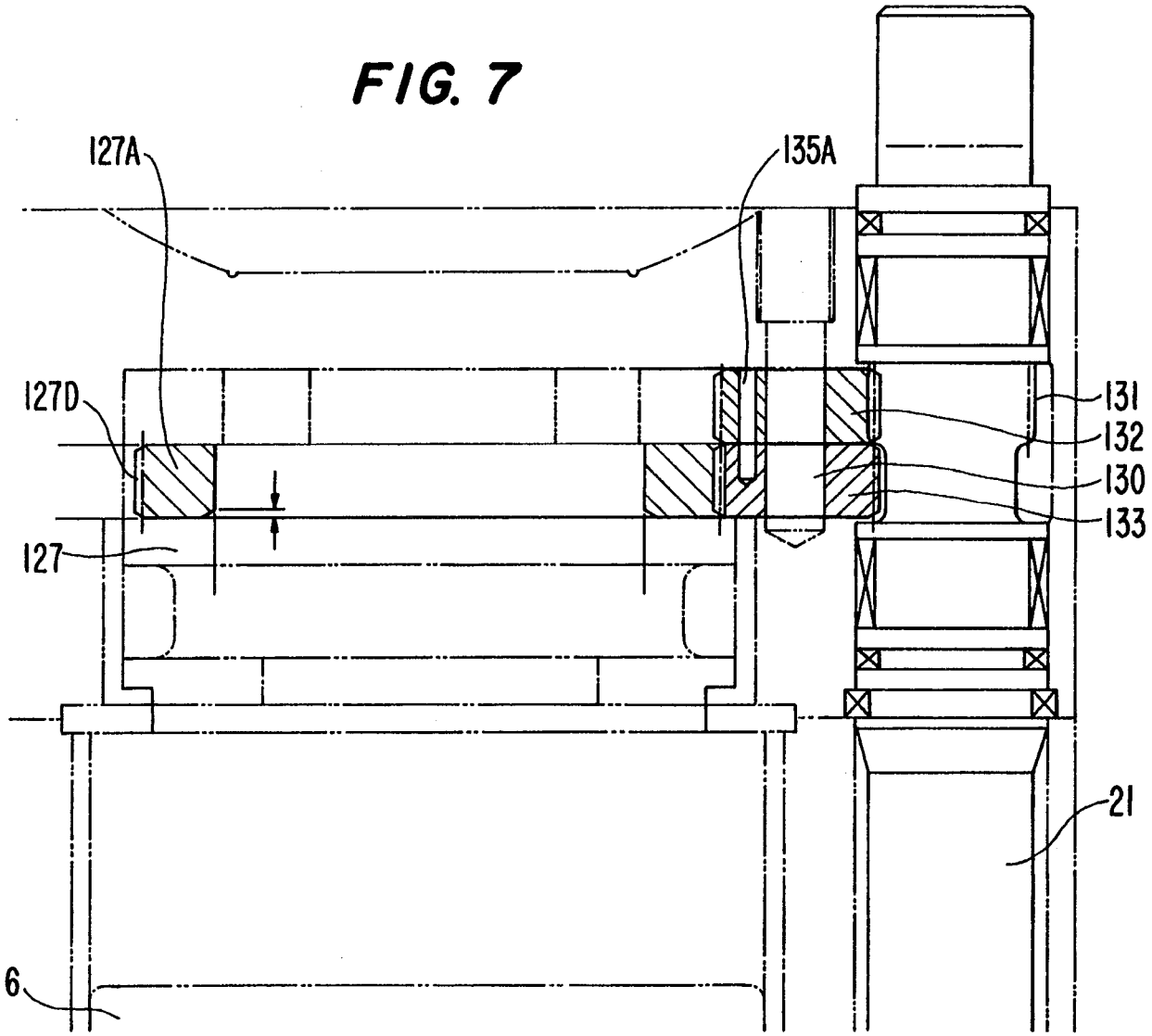
FIG. 7 shows an enlarged axial section through the pressure converter and the gear mechanism in FIG. 6.

Another and related aspect of this invention shall then be explained more closely with reference to FIGS. 6 and 7 of the drawings.

FIGS. 6 and 7 show in part somewhat schematically piston means 106 and valve means 127 as well as an annular ring 127A with a toothed rim 127D on the valve means. Also the through-running common drive axle 21 is shown.

As best seen in FIG. 7 the drive axle 21 for each pressure converter is provided with a drive gear 131 which via two intermediate gears 132 and 133 convey the rotary movement to the toothed rim 127D and thereby to the valve means 127. Gear 131 is in engagement with intermediate gear 132 and this in turn rotates intermediate gear 133 by means of entrainer elements in the form of axial pins, of which an entrainer pin 135A is shown in FIG. 7. It is an advantage to have three such entrainer pins provided at regular intervals around the circumference of these two intermediate gears. Otherwise both gears 132 and 133 are individually freely rotatable on an axle 130. Intermediate gear 133 is in engagement with toothed rim 127D.

The entrainer pins 135A have such dimensions and design that they shall serve as overload protection, which means that the pins are adapted to be sheared or broken at the occurance of a resistance or a torque which exeeds a predetermined magnitude. Accordingly, this may happen if valve means 127 is blocked or gets stuck for some reason or other. When entrainer pin or pins 135A are sheared, the upper intermediate gear 132 is released and can rotate freely around axle 130 without entraining valve means 127. Accordingly, the common through-running drive axle 21 will not be influenced and can continue its operation even when the valve means in one of the pressure converters has become stuck.

Corresponding protection against overloading may be provided for by employing a slip effect.

Instead of pin 135A which locks gears 132 and 133 rotationally to each other, these could be arranged so as to normally have sufficient frictional engagement against each other for torque to be transferred until a certain maximum magnitude, in order then to slip so as so avoid overloading.

I claim:

1. A converter assembly comprising:

at least two pressure converters mounted in a row axially above drill bit of a drill pipe for deep drilling, in particular for oil and gas, and for generating an increased fluid pressure utilizing energy in a drilling fluid flow down through the drill pipe to obtain an enhanced drilling effect by means of at least one high pressure jet adapted to have a cutting action in a surrounding rock formation, the pressure converters having axially abutting end faces of spherical shape; and attachment means axially interconnected with the pressure converters, the attachment means being flexible, thereby enabling small freedom of angular movement between axes of the pressure converters.

2. The converter assembly according to claim 1, wherein the end faces are formed by annular segments of a sphere.

3. The converter assembly according to claim 1, wherein the attachment means comprise compression springs and bolts arranged in an axial direction substantially parallel to the axis of the pressure converters at periphery of the pressure converters.

4. The converter assembly according to claim 3, wherein the bolts are stud bolts each having a threaded portion engaged in a first pressure converter, each bolt extending through a clearance in the first pressure converter such that a free end of each bolt is engaged with another pressure converter.

5. The converter assembly according to claim 3, wherein a compression spring is underneath a nut at the free end of each bolt.

6. The converter assembly according to claim 3, wherein the compression springs are cup springs.

7. The converter assembly according to claim 5, further comprising a plurality of cup-like protective parts each having a bottom portion and a side portion, the bottom portion having a substantially central annular through hole through which the free end of a corresponding bolt extends and a surface engaged with a corresponding compression spring, the side portion being positioned around the outer circumference of the corresponding compression spring.

8. The converter assembly according to claim 1, further comprising a pressure converter wherein a transmission mechanism transfers movement of a drive means to movement of a valve means when in a normal state, the transmission mechanism further comprising weakening or slipping means which, when in an overload state, puts the transmission mechanism out of operation, so that movement of the drive means does not result in movement of the valve means.

9. The converter assembly according to claim 8, wherein the transmission mechanism comprises a through axle driven by the drive means and a drive gear, the drive gear being engaged with an intermediate gear connection, the intermediate gear connection being engaged to a toothed rim on the valve means, the intermediate gear connection comprising two intermediate gears being mutually rotatable about a common axis and being normally coupled to each other rotationally by an entrainer element.

10. The converter assembly according to claim 9, wherein the entrainer element comprises at least one shearable coupling pin between said two intermediate gears.

* * * * *